US007913460B2

(12) United States Patent
Stollery

(10) Patent No.: US 7,913,460 B2
(45) Date of Patent: Mar. 29, 2011

(54) OBSERVATION SHELTER

(75) Inventor: David J. Stollery, Laguna Beach, CA (US)

(73) Assignee: Industrial Design Research, Inc., Santa Ana, CA (US)

( * ) Notice: Subject to any disclaimer, the term of this patent is extended or adjusted under 35 U.S.C. 154(b) by 500 days.

(21) Appl. No.: 11/616,225

(22) Filed: Dec. 26, 2006

(65) Prior Publication Data

US 2007/0175109 A1 Aug. 2, 2007

Related U.S. Application Data

(60) Provisional application No. 60/766,102, filed on Dec. 30, 2005.

(51) Int. Cl.
*E04B 7/16* (2006.01)

(52) U.S. Cl. ..... 52/69; 52/68; 52/90.1; 135/97; 135/117

(58) Field of Classification Search ..... 52/90.1, 52/66, 68, 72, 94, 204, 202, 207, 69, 70, 52/64, 79.5, 63; 135/97, 143, 144, 117, 121, 135/901

See application file for complete search history.

(56) References Cited

U.S. PATENT DOCUMENTS

| | | | | | |
|---|---|---|---|---|---|
| 1,526,527 | A | * | 2/1925 | Butler | 52/64 |
| 2,854,705 | A | | 10/1958 | McClaran | |
| 2,890,498 | A | * | 6/1959 | Bigelow | 52/69 |
| 3,762,111 | A | | 10/1973 | Harada | |
| 3,984,948 | A | | 10/1976 | Bussard | |
| D245,865 | S | | 9/1977 | Bostrom | |
| 4,054,064 | A | * | 10/1977 | Walker | 74/612 |
| D261,040 | S | | 9/1981 | Chambers | |
| 4,364,322 | A | | 12/1982 | van Room | |
| 4,416,089 | A | | 11/1983 | Lambke | |
| 4,453,350 | A | * | 6/1984 | Schantz et al. | 52/64 |
| 4,471,586 | A | * | 9/1984 | Shuch et al. | 52/36.2 |
| 4,535,713 | A | | 8/1985 | van Room | |
| 4,566,397 | A | | 1/1986 | Cavanaugh et al. | |
| 4,897,972 | A | | 2/1990 | Stollery | |
| D313,077 | S | * | 12/1990 | Minarro | D25/16 |
| D321,941 | S | | 11/1991 | Stollery | |
| 5,138,941 | A | * | 8/1992 | Strauss | 100/349 |
| 5,664,384 | A | * | 9/1997 | Cullinan | 52/507 |
| 6,341,451 | B1 | * | 1/2002 | Morton, Sr. | 52/64 |
| 6,718,995 | B2 | * | 4/2004 | Dotterweich | 135/131 |
| 6,840,572 | B2 | * | 1/2005 | Sillanpää | 296/215 |
| 7,000,362 | B1 | * | 2/2006 | Cullinan | 52/780 |
| D556,341 | S | * | 11/2007 | Jackson et al. | D25/16 |

OTHER PUBLICATIONS

Industrial Design Research, Inc., Design Concepts: Architectural, 2003, http://indesre.com/design/architectural.asp, Accessed Jun. 17, 2009.*

Brochure for Surveyor Life Guard Tower, Industrial Design Research, 8 pages.

* cited by examiner

*Primary Examiner* — Eileen Lillis
*Assistant Examiner* — James Ference
(74) *Attorney, Agent, or Firm* — Larry K. Roberts

(57) ABSTRACT

An observation shelter includes a plurality of generally upright walls including a first wall having a first window opening positioned therein and a second wall having a second wall positioned therein. First and second shutters are movable between respective raised and closed positions. The first and second shutters have respective shapes configured such that the shutters when in their respective raised positions meet at a joint extending from said corner to provide substantially continuous shelter from the sun for the first window opening and second window opening, and wherein with the first and second shutters in their respective closed positions, an extension portion of the first shutter is received in a pocket portion of the second shutter.

12 Claims, 13 Drawing Sheets

OBSERVATION SHELTER

CROSS-REFERENCE TO RELATED APPLICATION

This application claims priority from provisional application Ser. No. 60/766,102, filed Dec. 30, 2005, the entire contents of which are incorporated herein by this reference.

BACKGROUND

Observation structures are used for various purposes such as guard towers, lifeguard towers and the like. Observation structures may be exposed to the elements, and may be unattended when not in use.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
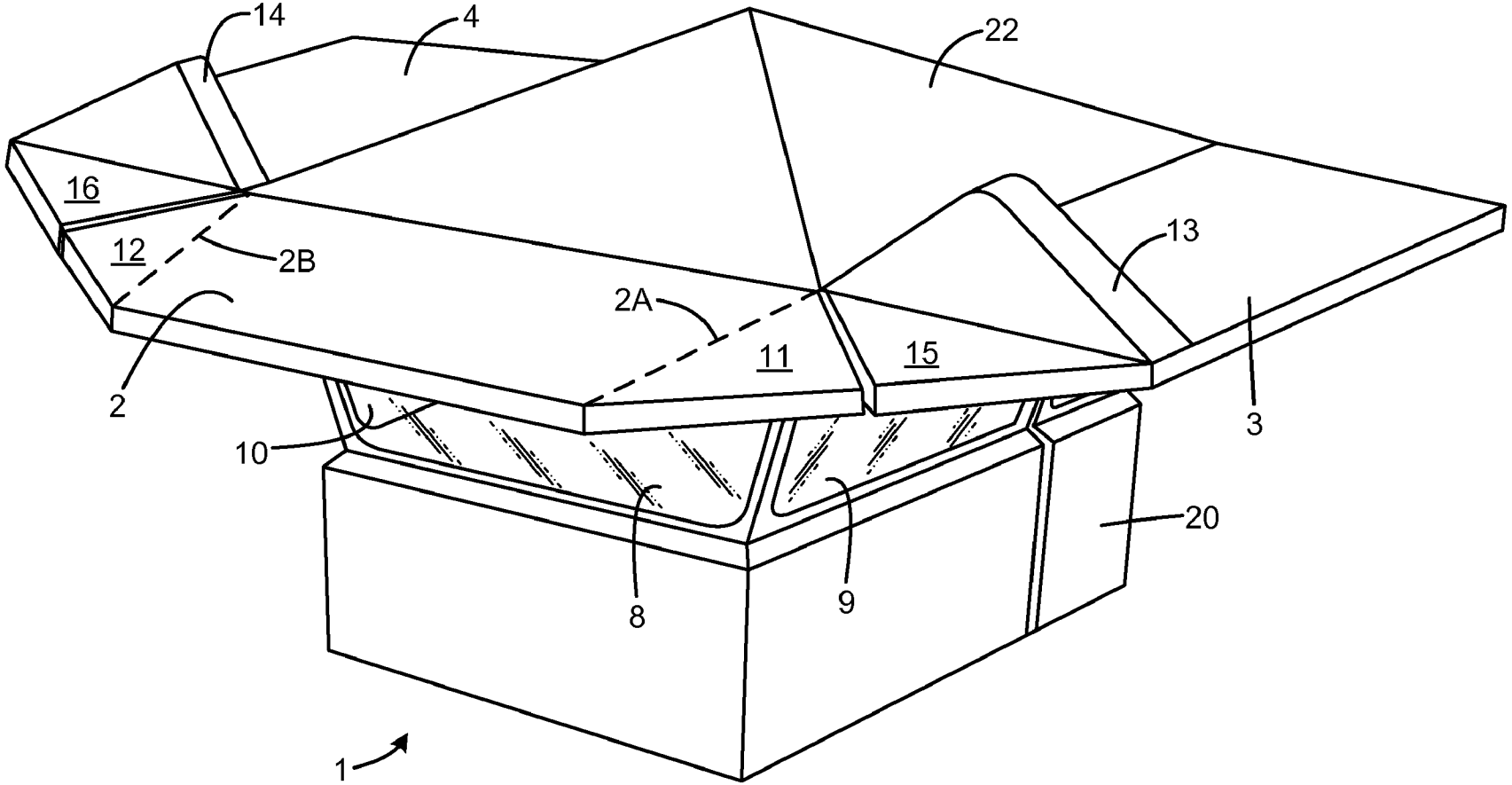
FIG. 1 is an isometric view of an exemplary embodiment of an observation structure.

In the following detailed description and in the several figures of the drawing, like elements are identified with like reference numerals. The figures are not to scale, and relative feature sizes may be exaggerated for illustrative purposes.

Figure 2:
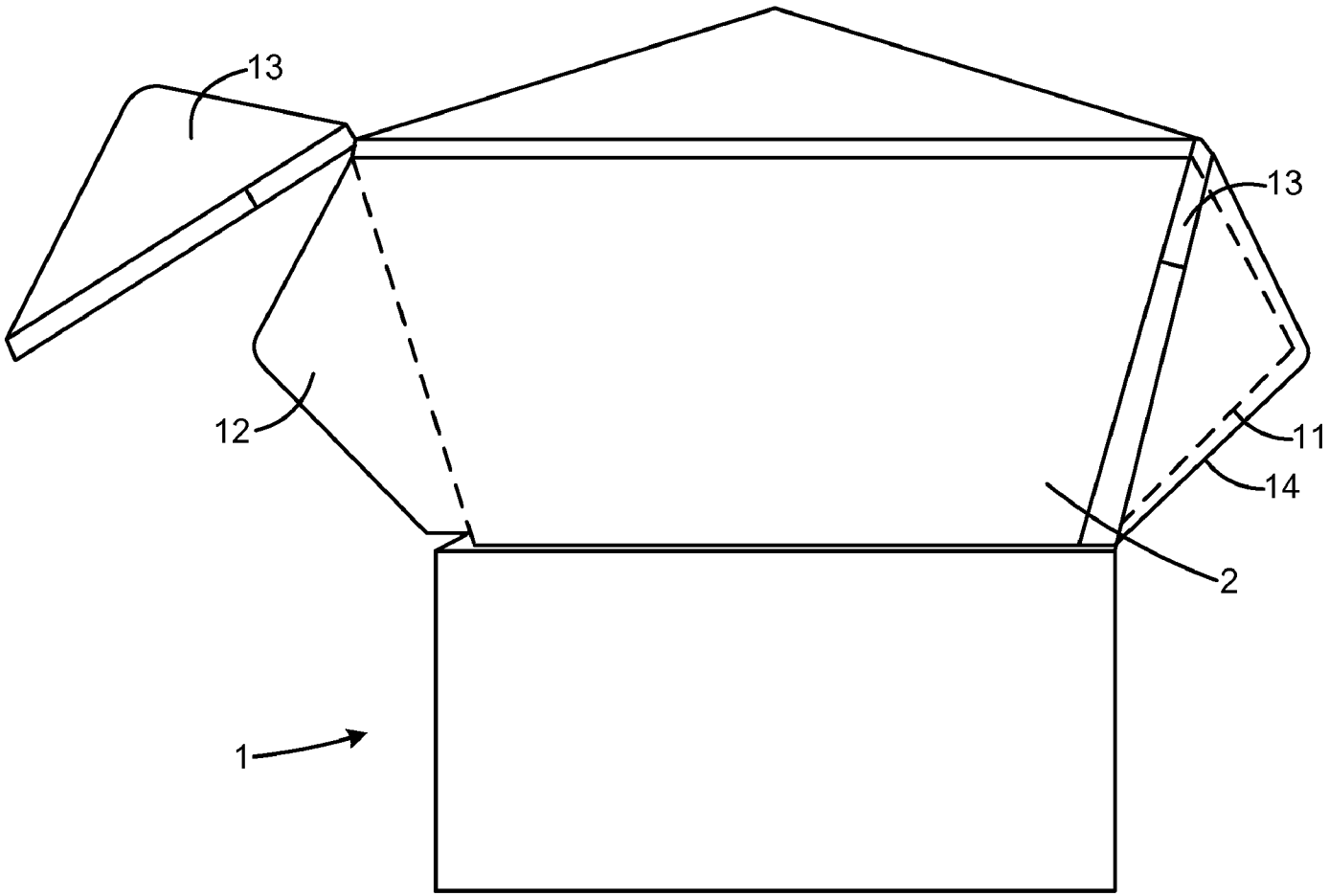
FIG. 2 is a front view of the structure of FIG. 1, with a closed front shutter, a closed left side shutter, and a partially open right side shutter.
Figure 3:
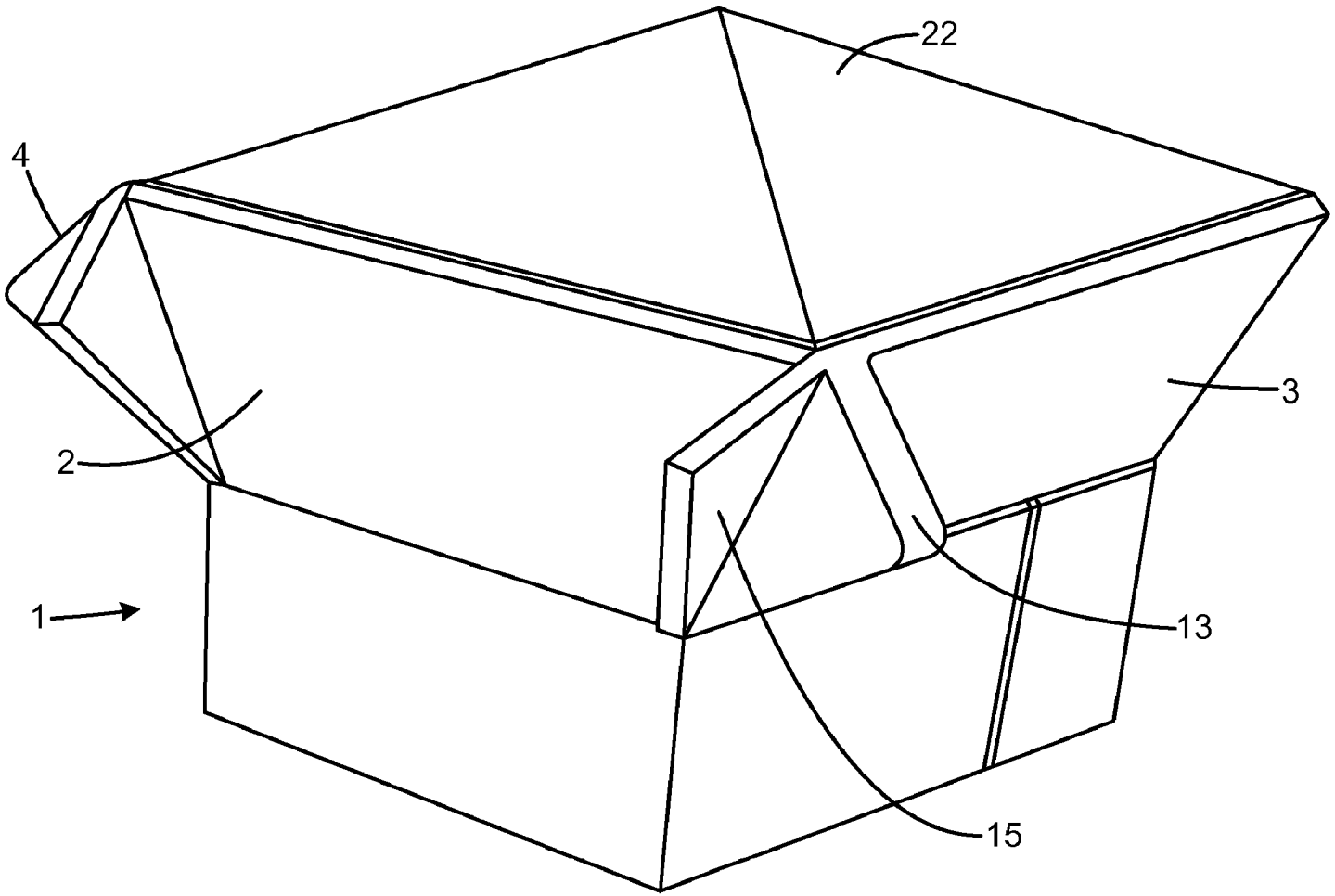
FIG. 3 is an isometric view of the shelter of FIG. 1, with the front shutter, left side shutter and right side shutter closed over the window openings to secure the un-occupied lifeguard shelter.

An exemplary embodiment of an observation shelter 1 is illustrated in FIGS. 1-3. The shelter 1 is provided with movable shutters 2, 3 and 4, with shutter 2 a front shutter, shutter 3 a left side shutter (as viewed from the perspective of a person standing inside the shelter and facing the front window opening 8), and shutter 4 a right side shutter. The shelter 1 in an exemplary embodiment has four walls, each with a window opening 8, 9, 10 placed therein to allow observation of the external environment by a person within the shelter. The window openings may have glass installed therein for some applications, and for other applications the openings are not covered by a transparent glass or glazing. A door 20 may provide entry to the interior of the structure. This exemplary embodiment of a shelter is particularly well suited to applications such as a lifeguard tower for a beach, ocean, lake or other body of water. For a lifeguard tower application, the structure may be mounted on a deck, which in turn is mounted to a platform. The platform may be fabricated of metal beams, to which skids may be attached to allow the shelter structure to be towed to and from designated beach sites.

FIG. 1 is an isometric view of an exemplary embodiment of the shelter 1 with the front shutter 2, the left side shutter 3 and the right side shutter 4 in the raised and open positions. The shutters may be attached to the roof structure 22 by hinges, allowed hinged movement of the shutters from raised or open positions to closed positions. Latches may be used to latch the shutters in the open positions (depicted in FIG. 1). The shape of the shutters may be so configured that, with the shutters in the raised, open position, they meet at a cut line or joint 7 generated from the corner of the shelter 1. This shape provides substantially unbroken shelter from the sun for the front window opening 8, the left side window opening 9, and the right side window opening 10. This may provide a benefit of reducing the amount of material needed to fabricate a shelter with full shelter from the sun.

The shutters may have a non-rectangular shape. For example, the front shutter 2 may include triangular extension portions 11 (bounded by phantom lines 2A, 2B which extend beyond a generally rectangular-shaped portion 2B of the shutter 2. The left side shutter 3 may have a triangular extension portion 15 outside a pocket structure 13 of the shutter 3. The right side shutter 4 may have a triangular extension portion 16 outside a pocket structure 14. The extension portions 11, 14, 15 of the shutters 2, 3 provide additional shutter area to provide shelter at otherwise exposed areas which are left unsheltered by conventional rectangular shutters. The pocket structures of the shutters 3, 4 provide receptacles in which the extension portions 11, 12 of the front shutter 2 may be received when the shutters are in closed positions.

FIG. 2 shows a front view of the shelter 1 with the front shutter 2 in a closed position and the left side shutter 3 closed over the extended triangular portion 11 of the left hand side of the front shutter 2. The right side shutter 4 is shown partially raised showing the uncovered extended portion 12 of the front shutter 2. The right hand shutter 4 and the left hand shutter 3 have pocket structures 13, 14 designed to close over the extension portions 11, 12 of the front shutter 2.

FIG. 3 is an isometric view of the lifeguard shelter 1 with the front shutter 2, left side shutter 3 and right side shutter 4, closed over the windows 8, 9, 10 in order to secure the unoccupied shelter. FIG. 3 shows the left shutter extension portion 15 and pocket 14 that covers the front shutter left extension portion 11 (shown in phantom).

Figure 4:
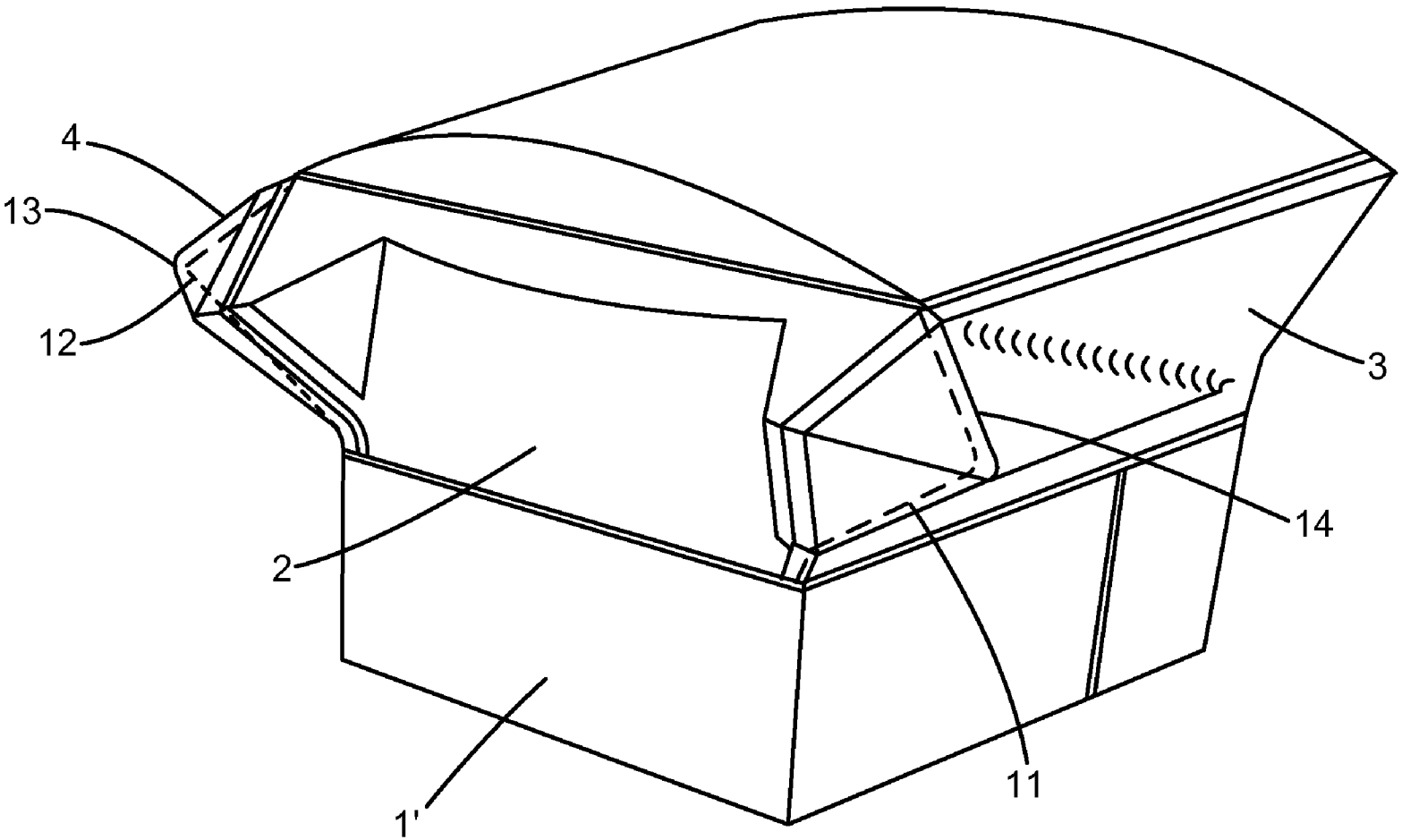
FIG. 4 is an isometric view of an alternate embodiment of an observation shelter.

FIG. 4 illustrates an alternate version of a lifeguard shelter 1 with the front shutter 2, left side shutter 3, and right side shutter 4 closed over the window openings 8, 9, 10 in order to secure the un-occupied lifeguard shelter. Although the appearance of the lifeguard shelter is changed, the functions of the front shutter extension portions 11, 12 and the side shutter pockets 13, 14 are still incorporated so as to provide the desired shielding from the sun.

One or more of the shutter pockets may alternatively be incorporated into the front shutter, so that the front shutter accommodates one or both of the extension portions of the side shutters.

Figure 5A:
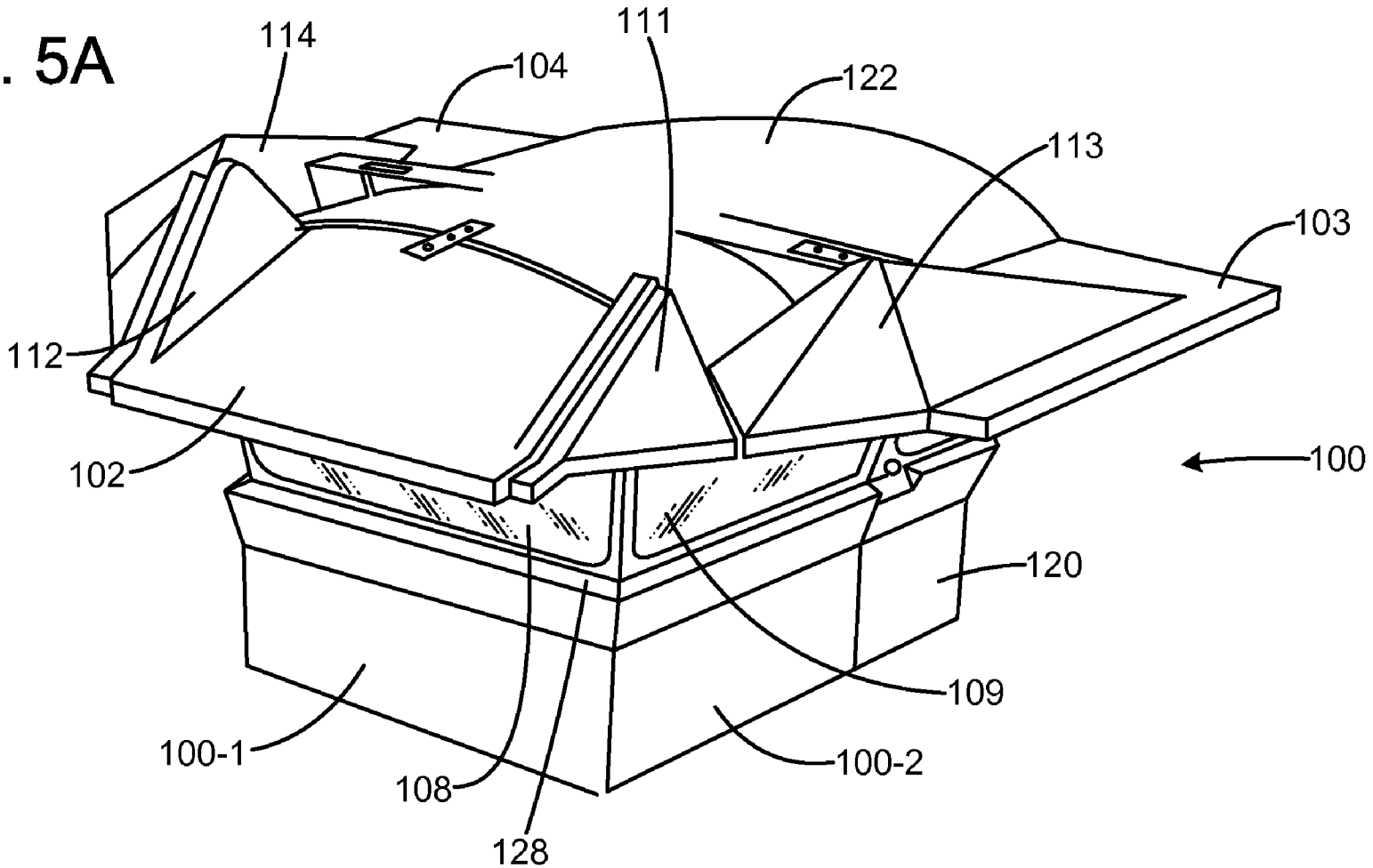
FIG. 5A is a rendering of an isometric view of a further exemplary embodiment of an observation shelter, with front, left side and right side shutters in the raised position.
Figure 5B:
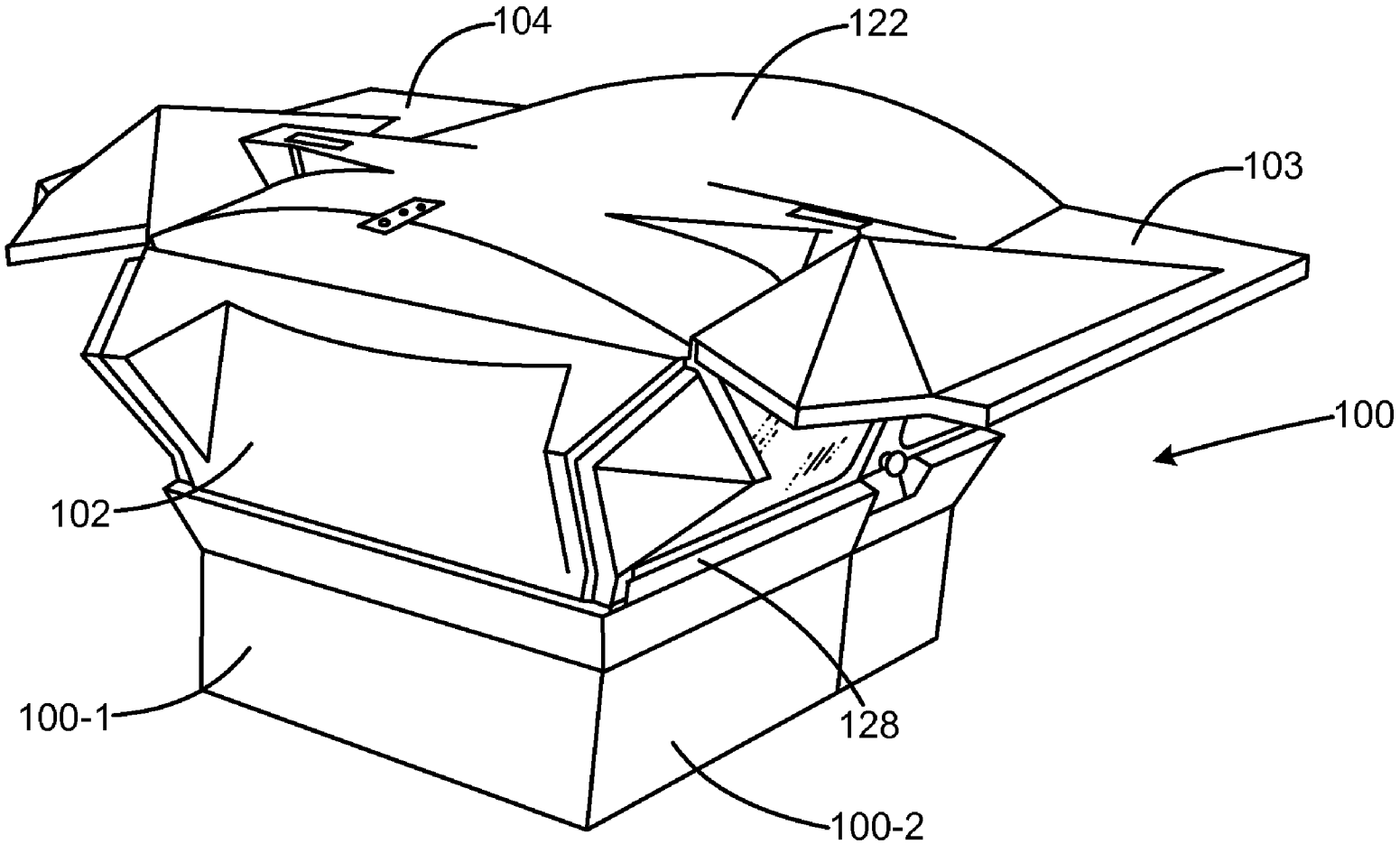
FIG. 5B is an isometric view of the observation shelter of FIG. 5A, with the front shutter in the closed position and the left and right side shutters in the raised position.
Figure 6:
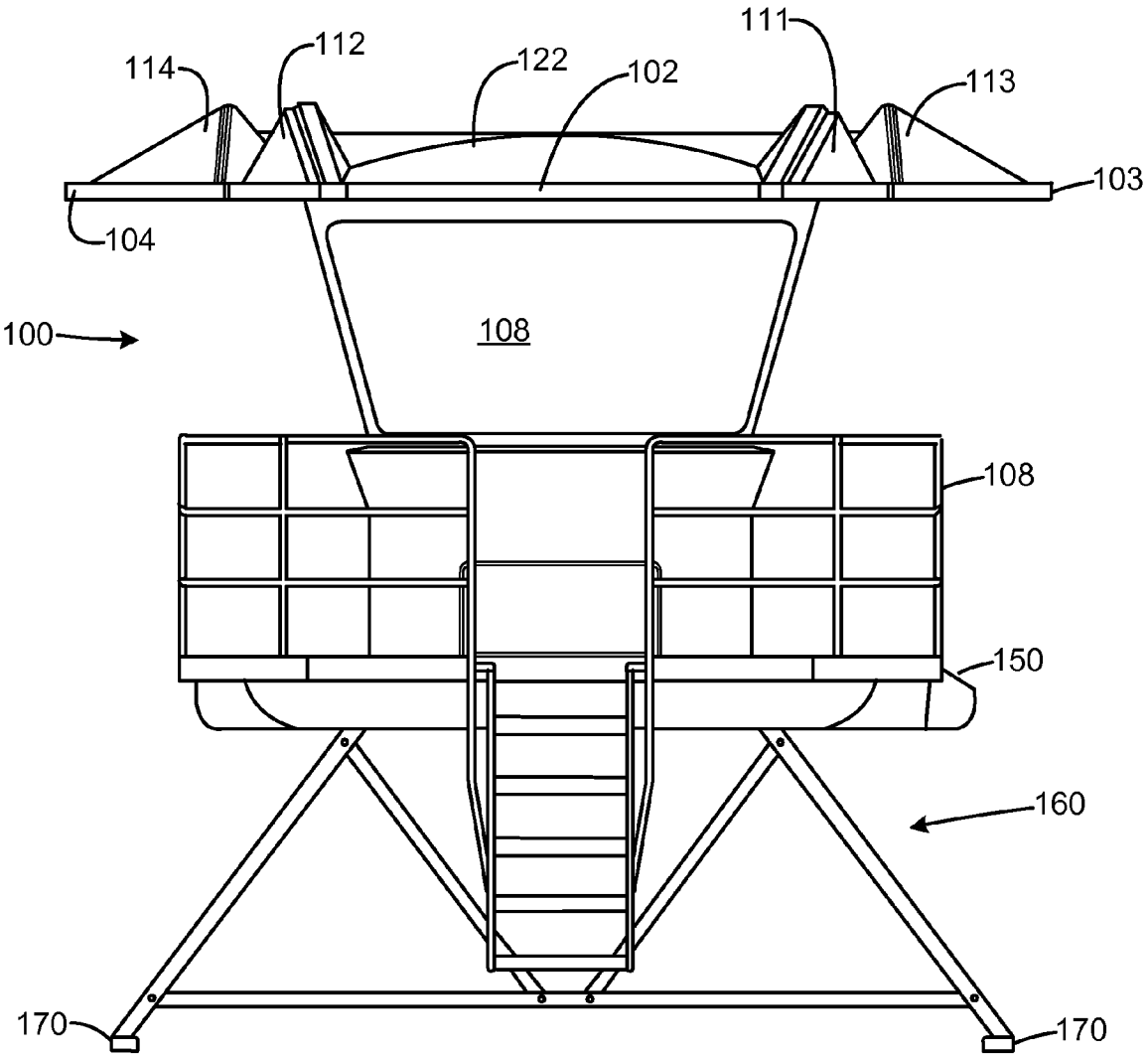
FIG. 6 is a front elevation view of an embodiment of an observation shelter mounted on a deck supported by a platform structure with skids.
Figure 7:
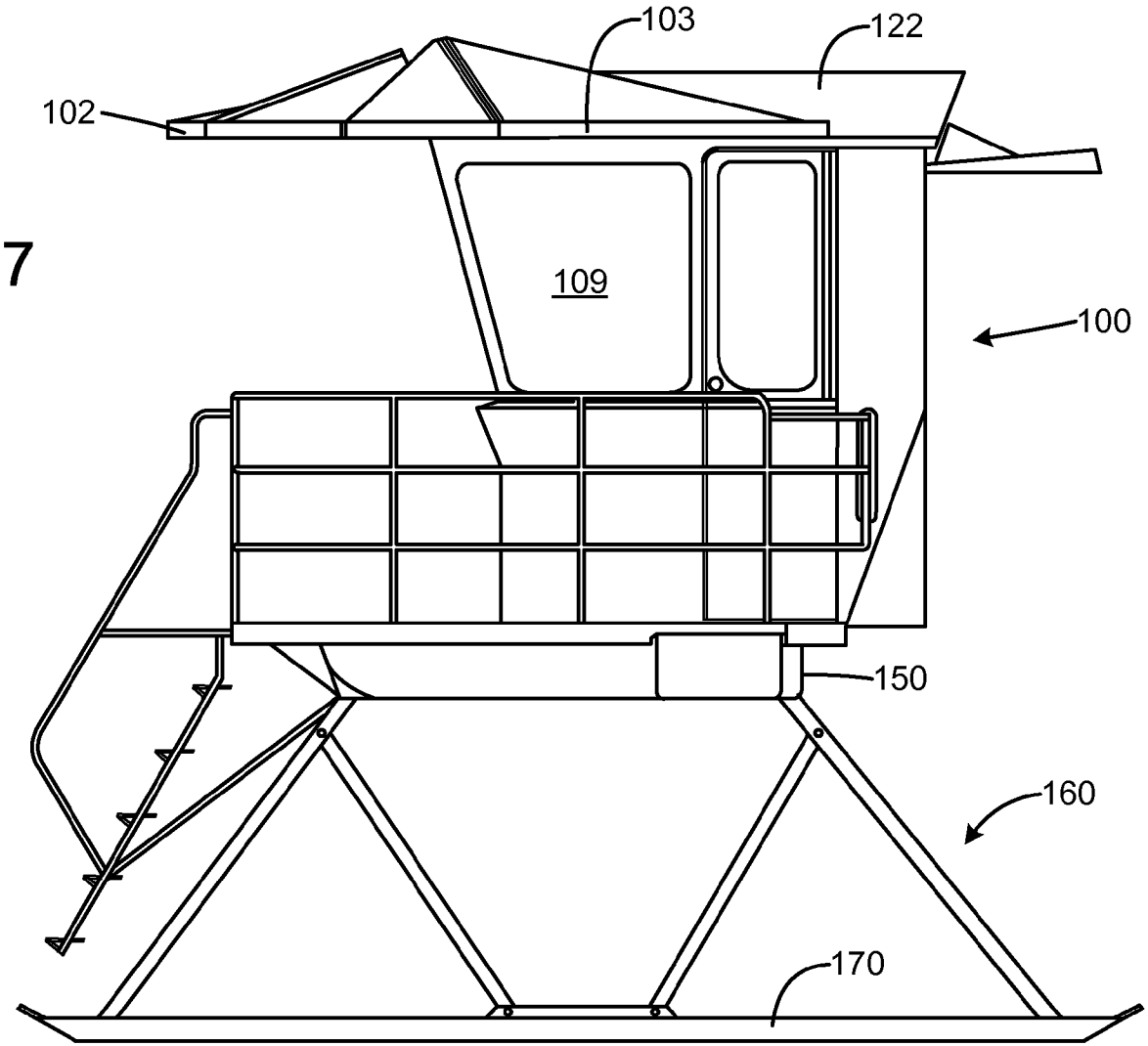
FIG. 7 is a right side elevation view of the embodiment of FIG. 6.
Figure 8:
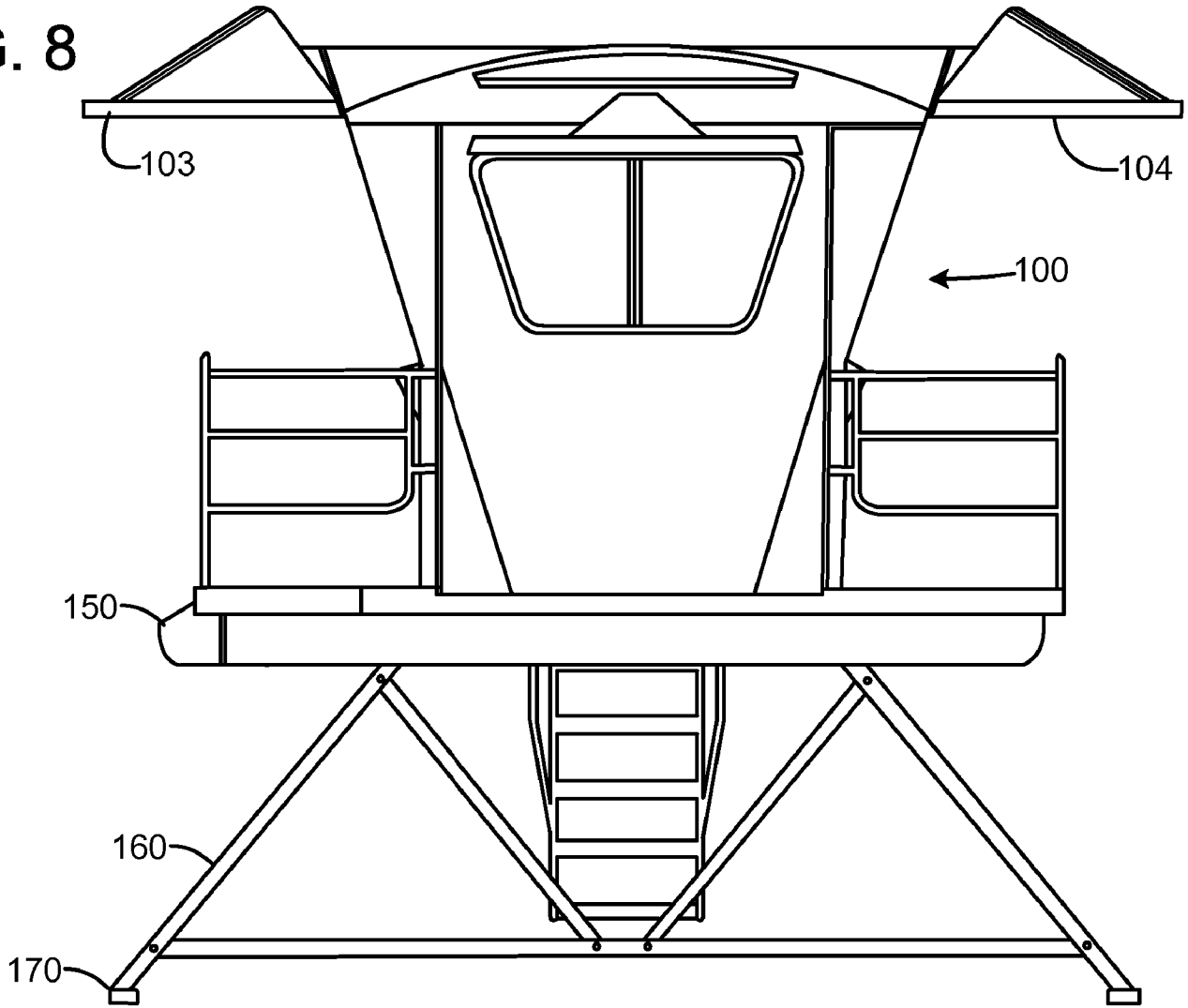
FIG. 8 is a rear elevation view of the embodiment of FIG. 6.

Another exemplary embodiment of an observation shelter is illustrated in FIGS. 5A-12. This embodiment of a shelter 100 includes walls including front wall 100-1 and side wall 100-2, with respective window openings formed in the front and side walls including window openings 108, 109. For some applications, the window openings may have window glazing installed therein. For other applications, the glazing or glass may not be included. The shelter further includes roof structure 122, and shutters 102, 103, 104 mounted for hinged movement between respective open positions and closed positions. FIG. 5A depicts the shutters in the open position, and FIG. 5B shows the front shutter 102 in the closed position, and side shutters 103, 104 in the open position.

In this exemplary embodiment, the extension portions 111 and 112 of the front shutter 102 are peaked or generally pyramidal shaped regions, which not only provide shielding against the sun, but also may provide structural rigidity and strength to the shutter. This may be advantageous for the exemplary embodiment in which the shutter is a one-piece structure fabricated from a layer or layers of fiberglass. Similarly the side shutters 103, 104 include pocket regions 113, 114 which are peaked or pyramidal regions which not only are shaped to enclose the extension portions 111, 112 of the front shutter in the closed position, but also may provide structural rigidly and strength to the shutters. In an exemplary embodiment, the shutters may be unitary structures molded of a fiberglass material.

elevation and top plan views of FIGS. 6-9 depict the shelter 100 mounted on a deck 150, which is supported on a platform structure 160 with skids 170, which may be useful for a beach application. FIGS. 6-9 depict the shutters 102-104 in the open position.

It will be seen that in an exemplary embodiment, the window openings 108, 109, 110 of the shelter are inset at bottom edges, so that a ledge or sill portion 128 (FIGS. 5A-5B) is formed just below the bottom of the window openings. This provides a surface against which the bottom edges of the shutters may abut when the shutters are closed, to enhance the security achieved by closing the shutters.

In the exemplary embodiment of FIGS. 5A-12, the roof structure 122 has a bowed or curved configuration which may be generally in the form of a sector of a cylinder. The side wall edges of the roof structure may be generally linear to meet with generally linear edges of the side shutters 103, 104. The front shutter may have a curved or bowed top edge to generally conform to the curvature of the roof structure along an edge at the front of the shelter. The bottom edge of the front shutter may have a generally linear form, to conform to the linear line formed by the ledge 128.

Figure 9:
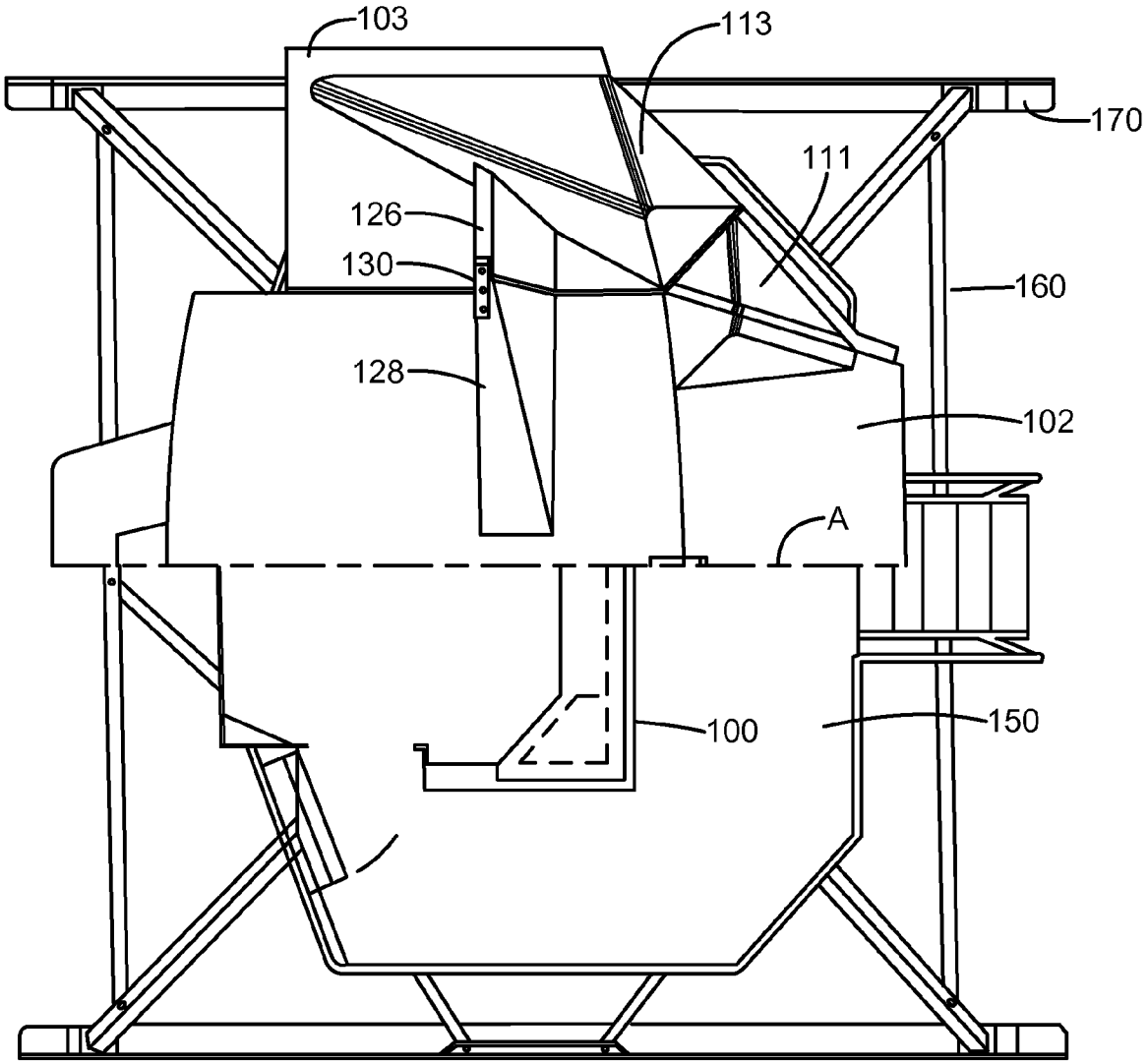
FIG. 9 is a top plan view of the embodiment of FIG. 6, with a portion of the deck and roof cut away to show a portion of a shelter interior.

The cut-away top plan view of FIG. 9 has the roof 122 and front shutter 102 cutaway along line A, illustrating interior features of the shelter 100. The right shutter is not shown in this figure. The shutters, e.g. shutter 103, may include another peaked region 126, situated to run generally transverse to the line A in this example, for providing a mounting point for a latch structure generally depicted as 130 in FIG. 9. The roof structure 122 may have a corresponding peaked region 128 which forms a stop shoulder against which the peaked region 126 of the shutter may abut to register the open position of the shutter, and provide a further mounting location for a portion of the latch structure 130. Each of the shutters 102-104 may be provided with a latch structure to provide a capability of latching the shutters in the open position, while readily being readily unlatched by a shelter user to close the shutters.

Figure 10:
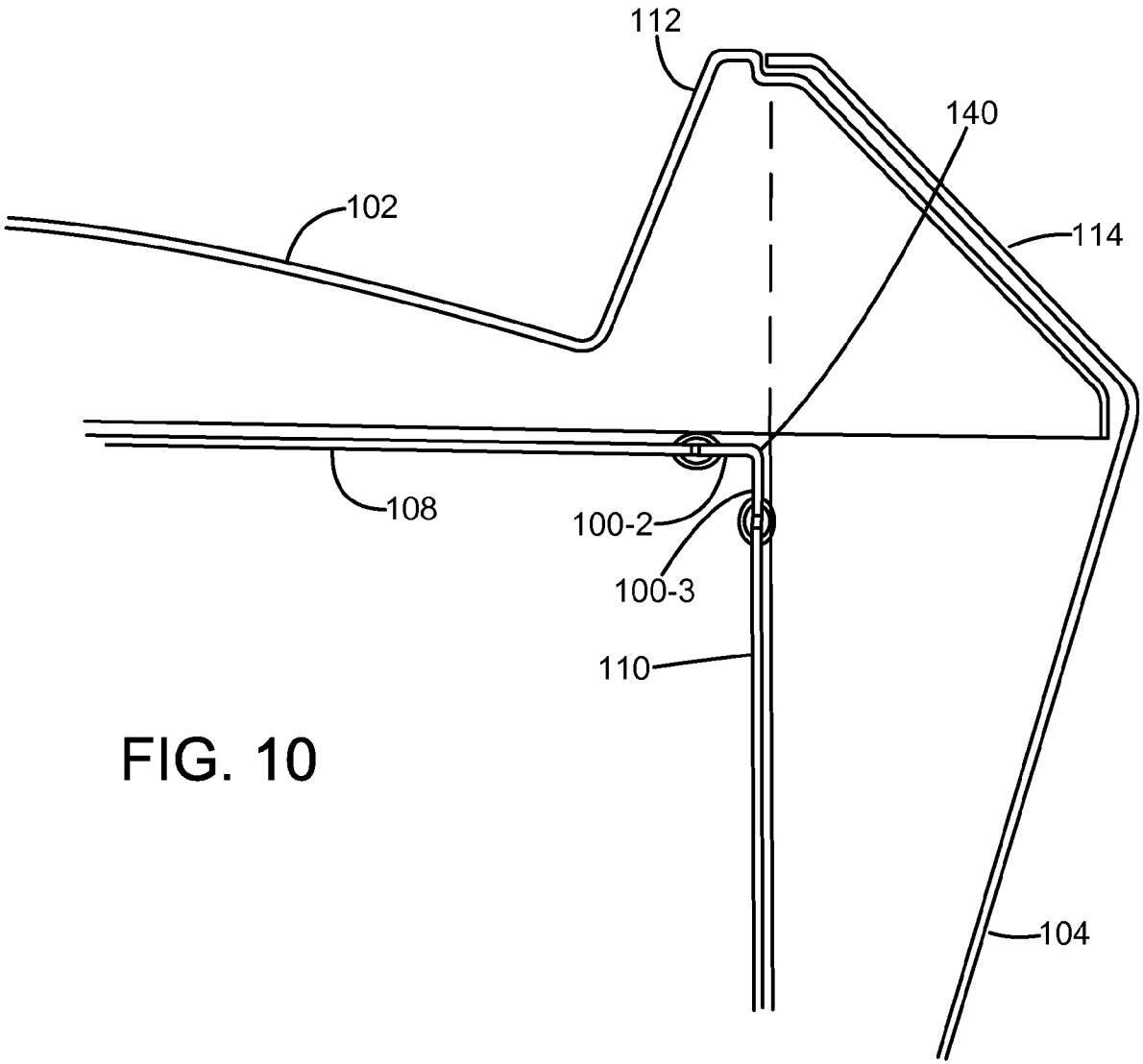
FIG. 10 is a partial cutaway top view of a corner between left side and front walls of the shelter of FIG. 6, illustrating a configuration of the left and front shutters in the closed position.

FIG. 10 is a partial cutaway view of a portion of the shelter 100, depicting portions of the shutters 102 and 104 in their closed positions. This illustration is a top view, showing the front window opening 108 and right side window opening 110 set into the front wall 100-1 and the right side wall 100-3, meeting at a corner region 140. The front shutter 102 is closed first, and the side shutter 104 closed thereafter. The extension portion 112 has a region which is enclosed or captured by the extension portion 114 of the side shutter 104 in this example. The right side shutter may be locked in place, e.g. by a locking pin accessible from the interior of the shelter, securing the front shutter in the closed position. The left side shutter has an extension portion 113 which encloses or captures a portion of the extension portion 111 of the front shutter on the left side, so that both sides of the front shutter are captured in place by the extension portions of the side shutters. A lock mechanism, which may include a padlock or key-operated lock, may be employed to lock the left side shutter in the closed position to prevent unauthorized access to the shelter interior. The lock mechanism for the left side may be operated by a person situated outside the shelter, while the lock mechanism for the right shutter may be operated only by a person situated within the shelter. The side shutters may also cover the doors 120 (FIG. 5A), so that a separate lock may not be need for the doors when made to open outwardly.

Figure 11:
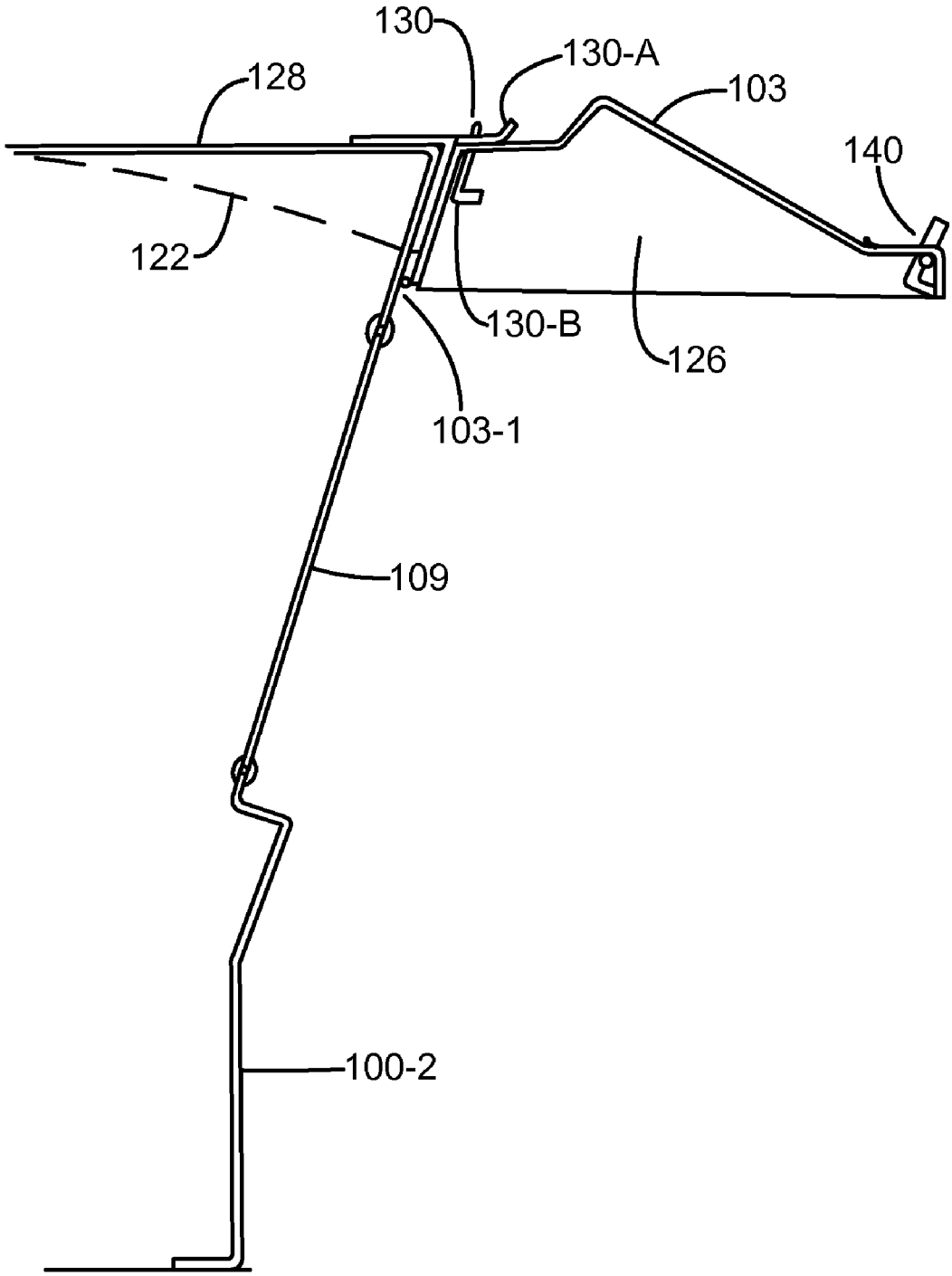
FIG. 11 is a diagrammatic cross-sectional view taken through the left shelter wall, roof portion and shutter, depicting an exemplary locking arrangement for locking the shutter in the upright position.
Figure 12:
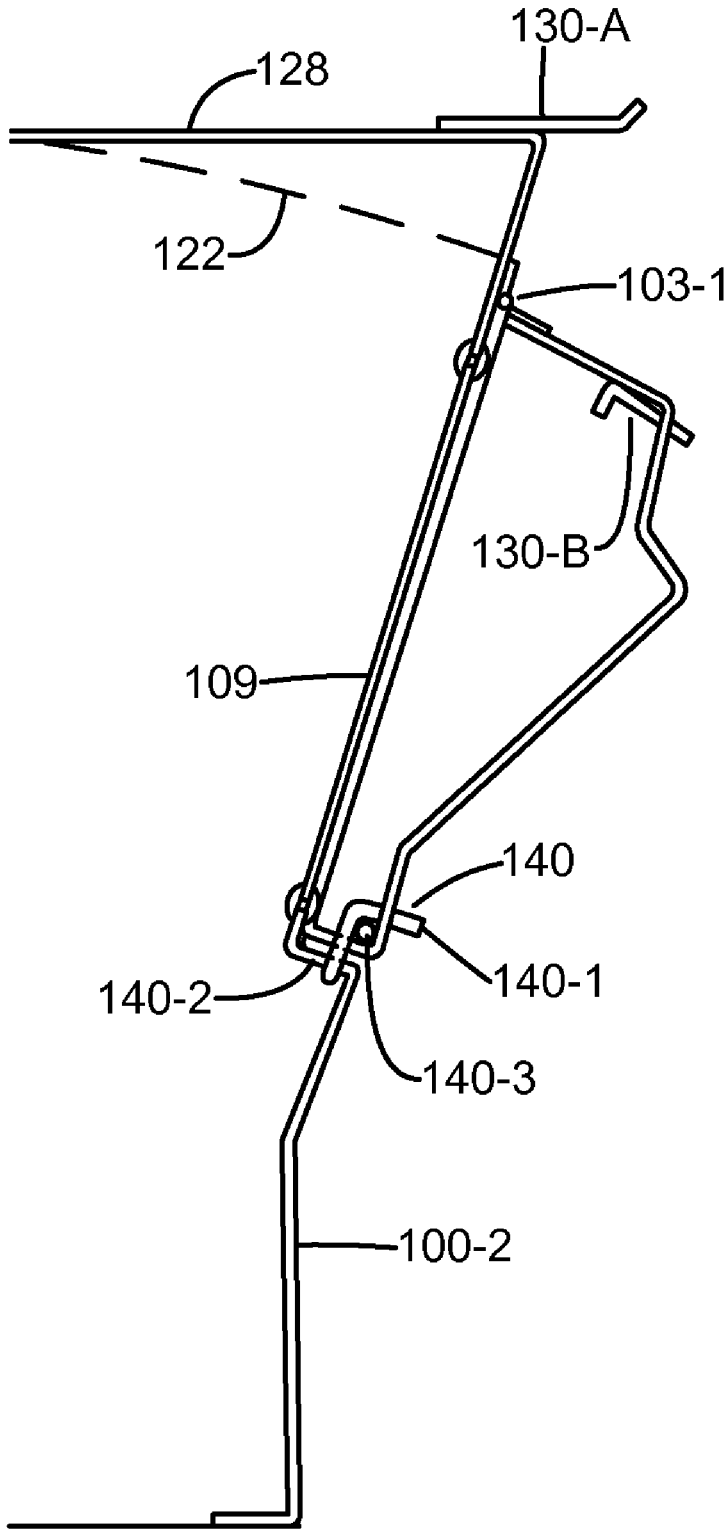
FIG. 12 is a diagrammatic cross-sectional view, showing the shutter of FIG. 11 in a closed, locked position.

FIGS. 11-12 depict partial cutaway views of a shutter, e.g. shutter 103, and exemplary latch structures to latch or lock the shutter in respective open (FIG. 11) and closed (FIG. 12) positions. The latch structure 130 includes a striker plate 130-A mounted to the peaked portion 128 of the roof 122, with a pin opening formed therein, and a spring-loaded lock pin 130-B carried in the peaked portion 126 of the shutter 103. The pin 130-B is movable between an extended position (to which the pin is biased by a spring) and a retracted position which allows the pin to be withdrawn from engagement with the striker plate and the shutter moved to the closed position by rotation about a hinge 103-1 which mounts the shutter 103 to the wall 100-2 in this exemplary embodiment. A latch structure 142 may be provided for latching the side shutter in the closed position to resist vandalism. The structure 140 may include a structure including actuator rod 140-3 which is mounted for pivoting movement, and which carries a lock pin 140-1 at each rod end. The rod is thus mounted for pivotal movement and when rotated counterclockwise with the shutter 103 in the closed position causes the pin 140-1 to be received in or a pin opening formed in wall surface 140-2. The rod 140-3 may be locked in the closed position by a padlock from the exterior, to prevent rotation which would withdraw the lock pin from the opening in the wall structure, thus preventing the opening of the shutter. Each of the shutters may include a latching or locking structure to secure the respective shutters in the raised, open positions. Of course, other arrangements may be employed to serve as latching or locking mechanisms.

In an exemplary embodiment, the walls, roof, door and shutters of the shelter may be fabricated of a moldable material. One exemplary material suitable for the purpose is a fiberglass material, e.g., 3/16 inch thick, which may be coated with a gel-coat finish. The windows may slope out from the bottom, e.g. at a 15 degree angle to the vertical, to reflect heat and reduce glare.

A shutter configuration which provides generally continuous shelter from the sun may reduce the weight and amount of material for fabrication of the shelter. The sun protection may be provided by shutters without use of additional structural shield elements. The shutters are also vandal resistant, which may be advantageous for times in which the shelter with shutters closed is left unattended.

Although the foregoing has been a description and illustration of specific embodiments of the invention, various modifications and changes thereto can be made by persons skilled in the art without departing from the scope and spirit of the invention as defined by the following claims

What is claimed is:

1. An observation shelter, comprising:

a roof structure;

a first wall having a first window opening positioned therein;

a second wall having a second window opening positioned therein, the first and second walls meeting at a first shelter corner;

a third wall having a third window opening positioned therein, the first and third walls meeting at a second shelter corner;

a first shutter movable between a raised position for sheltering the first window opening from the sun and a closed position for covering the first window opening, the first shutter including an extension portion;

a second shutter movable between a raised position for sheltering the second window opening and a closed position for covering the second window opening, the second shutter including a first pocket portion;

a third shutter movable between a raised position to shelter the third window opening from the sun and a closed position to cover the third window opening, the third shutter including a second pocket portion;

wherein the first, second and third shutters have respective shapes configured such that the shutters when in their respective raised positions meet or are positioned adjacent one another at first and second respective joints extending from said first and second corners to provide substantially continuous shelter from the sun for the first window opening and second window opening, and wherein with the first, second and third shutters in their respective closed positions, the first, second and third window openings are covered, the first extension portion of said first shutter is received in the first pocket portion of the second shutter, and the second extension portion of said first shutter is received in the second pocket portion of the third shutter.

2. The shelter of claim 1, wherein the second shutter includes an extension portion, and wherein the extension portions of the first and second shutter meet or are positioned adjacent one another at said first joint.

3. The shelter of claim 1, wherein said first shutter, said second shutter and said third shutter are hingedly mounted for hinged movement about respective hinge axes between the respective open and closed positions.

4. The shelter of claim 1, wherein the first, second and third shutters are fabricated of a fiberglass material.

5. The shelter of claim 1, wherein the second shutter includes a first generally pyramidal shaped portion which defines said first pocket portion.

6. The shelter of claim 5, wherein said first shutter includes a peaked portion which defines said extension portion of said first shutter.

7. The shelter of claim 1, wherein said second shutter includes a first peaked portion, and said roof structure includes a second peaked portion arranged to abut said first peaked portion when said second shutter is in the raised position.

8. The shelter of claim 7, further comprising a latch system for latching the first, second and third shutters in the raised position.

9. The shelter of claim 8, wherein the latch system latches the first peaked portion of the second shutter to the second peaked portion of the roof structure.

10. The shelter of claim 1, wherein the roof structure has a generally bowed configuration, wherein left and right side edges of the roof structure are generally linear, and a front edge of the roof structure is generally curved, and wherein a top edge of the first shutter is generally curved and a bottom edge is linear.

11. The shelter of claim 1, wherein the first second and third window opening openings are inset into said first second and third walls respectively to form a ledge, and bottom edges of said first second and third shutters are received against said ledge when in the closed position.

12. The shelter of claim 1, wherein each of the first, second and third shutters is fabricated as a unitary structure.

* * * * *